US007146112B2

(12) United States Patent
Phipps et al.

(10) Patent No.: US 7,146,112 B2
(45) Date of Patent: Dec. 5, 2006

(54) REPLACEABLE UNIT MONITOR READER WITH AUTO POLLING CAPABILITIES

(75) Inventors: William H. Phipps, Fairport, NY (US); Scott J. Bell, Rochester, NY (US); Alberto Rodriguez, Webster, NY (US); Heiko Rommelmann, Penfield, NY (US); Ronald P. Boucher, Rochester, NY (US)

(73) Assignee: Xerox Corporation, Stamford, CT (US)

( * ) Notice: Subject to any disclaimer, the term of this patent is extended or adjusted under 35 U.S.C. 154(b) by 113 days.

(21) Appl. No.: 11/034,249

(22) Filed: Jan. 13, 2005

(65) Prior Publication Data

US 2006/0153579 A1 Jul. 13, 2006

(51) Int. Cl.
*G03G 15/00* (2006.01)

(52) U.S. Cl. ..... 399/12; 399/24; 340/572.1

(58) Field of Classification Search ..... 399/8, 399/12, 24, 25; 340/572.1, 10.3, 5.61, 572.4, 340/10.5, 10.51, 10.52
See application file for complete search history.

(56) References Cited

U.S. PATENT DOCUMENTS 5,550,547 A * 8/1996 Chan et al. ..... 342/42
5,959,530 A * 9/1999 Lupien et al. ..... 340/568.1
5,975,736 A * 11/1999 Simmons et al. ..... 700/3
6,233,409 B1 * 5/2001 Haines et al. ..... 399/10
2003/0063147 A1 * 4/2003 Walker ..... 347/19
2003/0233548 A1 * 12/2003 Moreaux et al. ..... 713/168
2004/0242196 A1 * 12/2004 Beach ..... 455/410
2005/0057368 A1 * 3/2005 Corbett et al. ..... 340/825.49
2005/0120260 A1 * 6/2005 Suzuki et al. ..... 714/5

FOREIGN PATENT DOCUMENTS

GB 2410867 A * 8/2005

* cited by examiner

*Primary Examiner*—Robert Beatty
(74) *Attorney, Agent, or Firm*—Oliff & Berridge, PLC

(57) ABSTRACT

A replaceable unit monitor reader system includes a host processor and a coupler board. The coupler board has a detection circuitry that provides an auto-detect, auto-initiate and/or auto-select ability. After receiving command from the host processor, the coupler board enables communication with a CRUM without requiring a further command from the host processor.

24 Claims, 9 Drawing Sheets

REPLACEABLE UNIT MONITOR READER WITH AUTO POLLING CAPABILITIES

Co-pending applications with U.S. patent application Ser. Nos. 11/012,478, 11/034,248, 11/013,798, 11/012,480, 10/978,423, 11/012,479, 11/034,058 and 11/013,703 are incorporated herein in their entirety by reference thereto.

BACKGROUND

A replaceable unit monitor (RUM), such as a customer replaceable unit monitor (CRUM) or an engineer replaceable unit monitor (ERUM), is used to monitor the status of a replaceable unit (RU). For example, a CRUM reader accesses a CRUM and obtains the information regarding the status of a customer replaceable unit (CRU).

A Radio Frequency (RF) RUM reader system may include a host processor (or host) and a Coupler board (or coupler) that is a communications interface between the host processor and the RF RUM such as a radio frequency identification (RFID) tag. In order to access an RFID tag, the host processor is directly involved in a number of steps to Initiate and Select the tag before it is possible to communicate with it. This consumes considerable amount of the host computer's processing time. This is particularly true when the tag dynamically moves in and out of the system's RFID Coupler board's radio frequency field. In this case the host's real processing time is wasted when it is attempting to initiate a tag that is not in the RF field.

SUMMARY

Thus, it is desirable that the host processor be relieved of the effort to Initiate and Select a tag, so that the host processor could spend more of its processing time performing other tasks.

Instead of making the host repeat the necessary commands, a Coupler board is provided to repeatedly attempt to perform the following functions: 1) Initiate an RF RUM (or tag), and then notify the host when there has been a tag response; and/or 2) Initiate and Select an RF RUM (or tag), and then notify the host when the task has been completed.

An electronic circuitry is added to the coupler board either in the form of discrete components or integrated as part of an Integrated Circuits design. The electronic circuitry added to the coupler board can receive a single command from the host processor, or be started in some other manner. Based on this single command the Coupler board will repeatedly attempt to Initiate and perhaps also Select an RUM, without interacting with the host processor. The Coupler board will continue this "Auto-Detect," "Auto-Initiate" or "Auto-Select" sequence until an RUM is detected, initiated or selected, or the detection process is terminated by the host.

With the added electronic circuitry present in the coupler board, the host processor is relieved of all or part of the RUM Initiation and perhaps Selection processing. For example, the host processor may Initiate and perhaps Select (or simply detect) an RUM by issuing a single command to the coupler board, without going through several repeated steps that are involved with the process of Initiating and Selecting the RUM. Thus, the host processor can concentrate its processing time on performing other tasks.

The results of having the added electronic circuitry may be that the Coupler board can POLL for the presence of an RUM upon the reception of a single command from the host processor. This can be done from the RUM reader (or system coupler board), without the host processor continuously interacting with the RUM coupler board. The results may also be reported by the RUM coupler board to the host processor at Initiation of the RUM, or simply at the detection of the RUM. The results could also be reported at the Selection of the RUM. It would depend on the command sent to the Coupler board.

The report may be in the form of a data signal. The data signal may be sent from the coupler board to the host processor via a dedicated line connected to a high level interrupt. The data signal may also be sent via the data line using an inter-integrated circuit ($I^2C$ or I2C) interface. This would be done with a simple acknowledge in response to a read command from the host. The acknowledgement would be provided after the Coupler has detected the tag and placed the results of the Coupler/tag data exchange in an appropriate status register. It could also be done after the Coupler board has both Initiated and Selected the tag.

Thus, a replaceable unit monitor (RUM) reader system is provided. The system includes a host processor that outputs a command; and a coupler board including a detection circuitry that, upon receiving the command from the host processor, repeatedly attempts to enable communication with a replaceable unit monitor (RUM) without requiring a further command from the host processor.

These and other features and details are described in, or are apparent from, the following detailed description.

BRIEF DESCRIPTION OF THE DRAWINGS

Various exemplary details of systems and methods are described, with reference to the following figures, wherein.

DETAILED DESCRIPTION OF EMBODIMENTS

Figure 1:
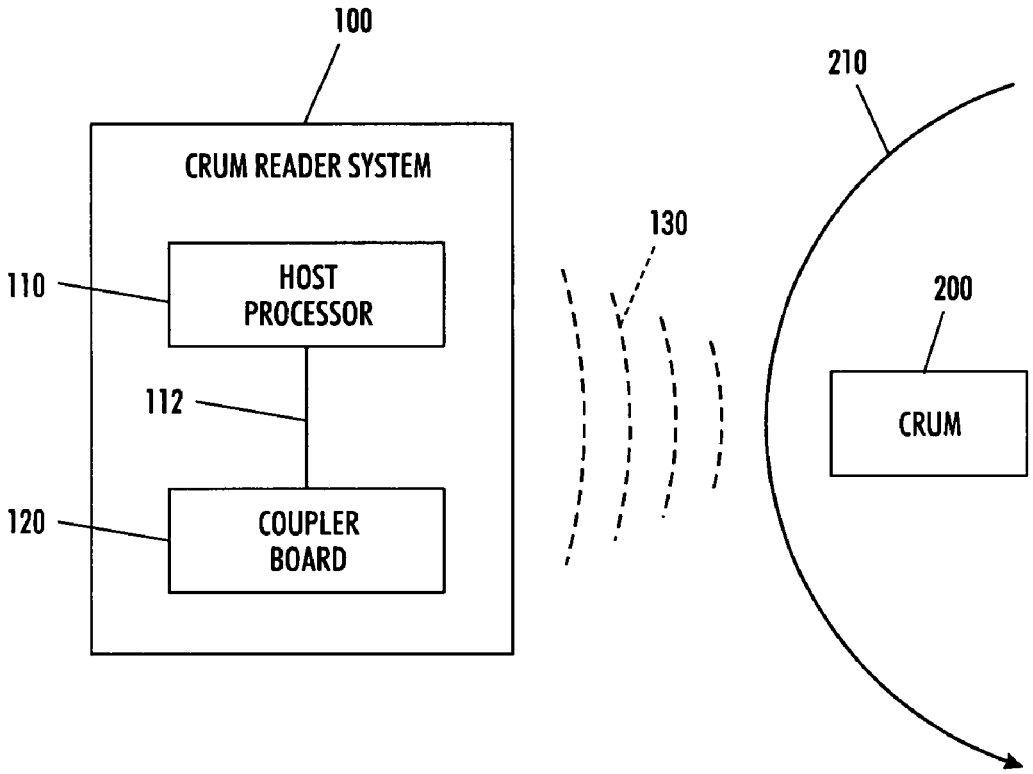
FIG. 1 RELATED ART
FIG. 1 illustrates a related-art RUM reader system.

An RF RUM system includes a host processor, a coupler board having an antenna, and an RUM. The RUM may be an RF-RUM, such as an RFID tag. The antenna may be integrated with the coupler board, or may be a separate element that is connected to the coupler board. The coupler board has added circuitry to allow the coupler board to Initiate and Select an RF-RUM without needing individual instructions for each command from the host to complete or repeat the objective of Initiating/detecting an RF RUM or Initiating and Selecting a RF-RUM. The added circuitry can be discrete active and passive electronic components or designed into an individual integrated circuit (IC).

An RUM may be mounted on or embedded in a replaceable unit, such as a rotating toner bottle of a marking device such as a printer, photocopier, or facsimile machine, or the like. As the toner bottle rotates or when the replaceable unit is installed into or removed from the marking device, the RUM moves in and out of the proximity of an RUM reader system, and an antenna of the RUM moves in and out of the radio frequency field of the system's coupler board.

One or several memory locations of the RUM may be used to represent the status of the replaceable unit. The information registered in the memory may be configured by the RUM manufacturer, the original equipment manufacturer, or may be updated by the system software.

RFID systems may be capable of communicating with multiple tags as they reside in the same RF field produced by a Coupler board. To do this the system needs to be able to address each tag in the Coupler's field. This is where the Initiate function comes in. When the tag is powered up by the RF field it generates a random number that is referred to as its chip ID. After receiving the Initiate command the RFID tag responds by sending back its chip ID. With the chip ID the host is now capable of addressing/Selecting that particular RFID tag. If there are two tags that respond at the same time, the data will be corrupted. However, the host can still be made aware of the fact that there is a tag in the field because corrupted data still indicates that there is a tag in the field. This particular use of the corrupted data could be referred to as "RF RUM Detection."

The Initiation of the RUM may include a detection of the existence of the RUM in a radio frequency field. The initiation may further include an initial communication with the RUM.

After an RFID tag has been Initiated it can then be Selected. This may be accomplished by the host with another command, the Select command. In this case the ID may be sent to the tag (or tags) in the RF field. Only the tag with the matching ID will respond. The tag's response may consist of a resend of its ID just like with the Initiate command discussed above.

With some systems the RFID tag may not be in the field at all times. Rather the tag may randomly move into the field and then out of the field. For these systems the host must repeat the above procedures in order to find and confirm the fact that an RFID tag is in the RF field of the Coupler board and it is able to communicate. This can take up significant processor time.

The following description is based on a CRUM reader system as an example. It should be appreciated that the description applies to engineer replaceable unit monitor (ERUM) reader systems and, in general, to Radio Frequency replaceable unit monitor (RF-RUM) reader systems.

FIG. 1 illustrates a related-art RF replaceable unit monitor (RUM) reader system, illustrated in this example as an RF CRUM reader system. As shown in FIG. 1, the CRUM reader system 100 includes a host processor 110 and a coupler board (also referred to as coupler circuitry or a coupler chip) 120, interconnected by data/control bus 112. The CRUM reader system 100 accesses a CRUM 200, such as an RFID tag.

The CRUM 200 may be a tag assembly that includes a memory integrated circuit (IC) chip connected to an antenna (not shown). The CRUM 200 receives power via a radio frequency (RF) carrier signal that is transmitted by the coupler board 120. The CRUM 200 communicates with the coupler board 120 by, for example, changing the impedance of its antenna in a way that is detectable by the coupler board 120. A more detailed description of a CRUM system may be found in application Ser. No. 11/013,703, with which is incorporated herein in its entirety by reference thereto.

The coupler board 120 is an interface between the host processor 110 and the CRUM 200. The coupler board 120 may include an integrated circuit (IC) chip, associated circuitry (not shown), and an antenna. The coupler board 120 transmits an RF carrier signal that powers the RFID tag (RUM) when it is in sufficient proximity to the coupler board. The RF carrier signal also transmits instructions to the tag. The coupler chip (or electronics) does this by modulating the carrier signal with encoded data. The RFID tag communicates back to the coupler by altering the RF carrier signal by changing it's own characteristic impedance. By loading the signal the RFID tag is capable of modulating the RF carrier with its own encoded data. This is commonly known as back scattering.

The host processor 110 may use a predetermined command set. The command set includes commands such as INITIATE, SELECT, READ, WRITE, AUTHENTICATE, etc. The host processor 110 controls the coupler board 120 via data/control bus 112. The coupler board 120 passes the commands to the CRUM 200 via, for example, a modulated radio frequency carrier.

The CRUM 200 may be physically (or geographically) static. Alternatively, the CRUM 200 may be dynamically moving. In the example shown in FIG. 1, the CRUM 200 moves along path 210. When the CRUM 200 is in the proximity of the CRUM reader system 100, the antenna of the CRUM 200 comes into the radio frequency field 130. When this happens, the communications between the Coupler board 120 and the CRUM 200 are possible. The CRUM 200 may be interrogated by the CRUM reader system 100.

The CRUM 200 may be mounted on or embedded in a toner bottle of a printer. The toner bottle may rotate. As the toner bottle rotates, the CRUM 200 moves in and out of the proximity of the CRUM reader system 100. The CRUM 200 registers a status of the toner bottle, such as how much longer the supply of the toner bottle can last. The information of the status of the toner bottle may be registered by the manufactures, or may be updated by software. For example, the software of the printer may update the status of the toner bottle each time the printer uses the toner bottle for printing.

When interrogating the CRUM 200, the CRUM reader system 100 may require real processor time from the host processor 110. Thus, the host processor 110 may be unable to perform any other task while interrogating the CRUM 200. Also, the CRUM 200 needs to be initiated before the host processor 110 is able to communicate with it. Thus, the longer the host processor 110 is involved in the initiation process, the longer the host processor 110 is unable to perform other tasks.

Figure 2:
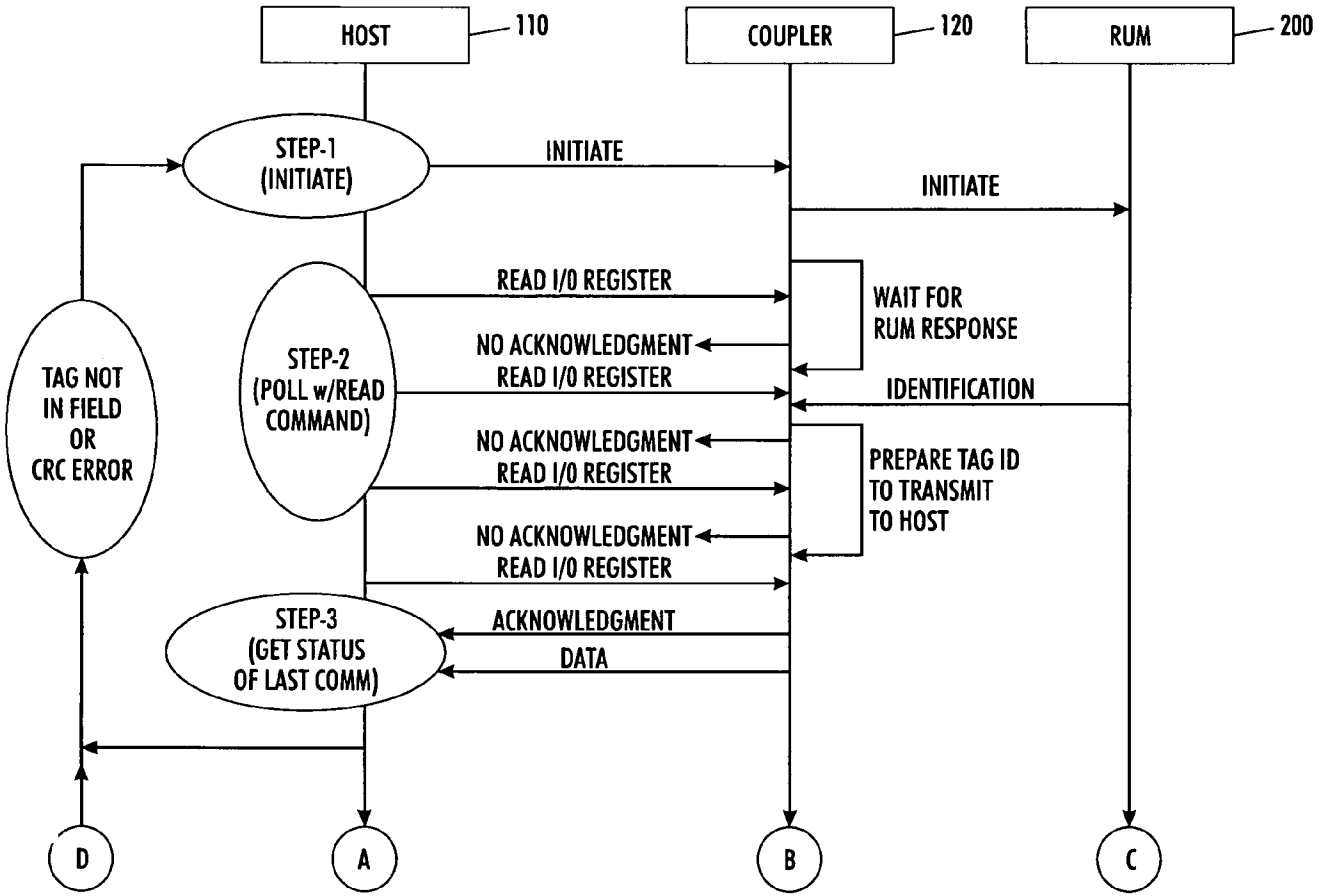
FIG. 2 RELATED ART
FIGS. 2 and 3 illustrate a related-art sequence that outlines the steps to Initiate and Select a tag.
Figure 3:
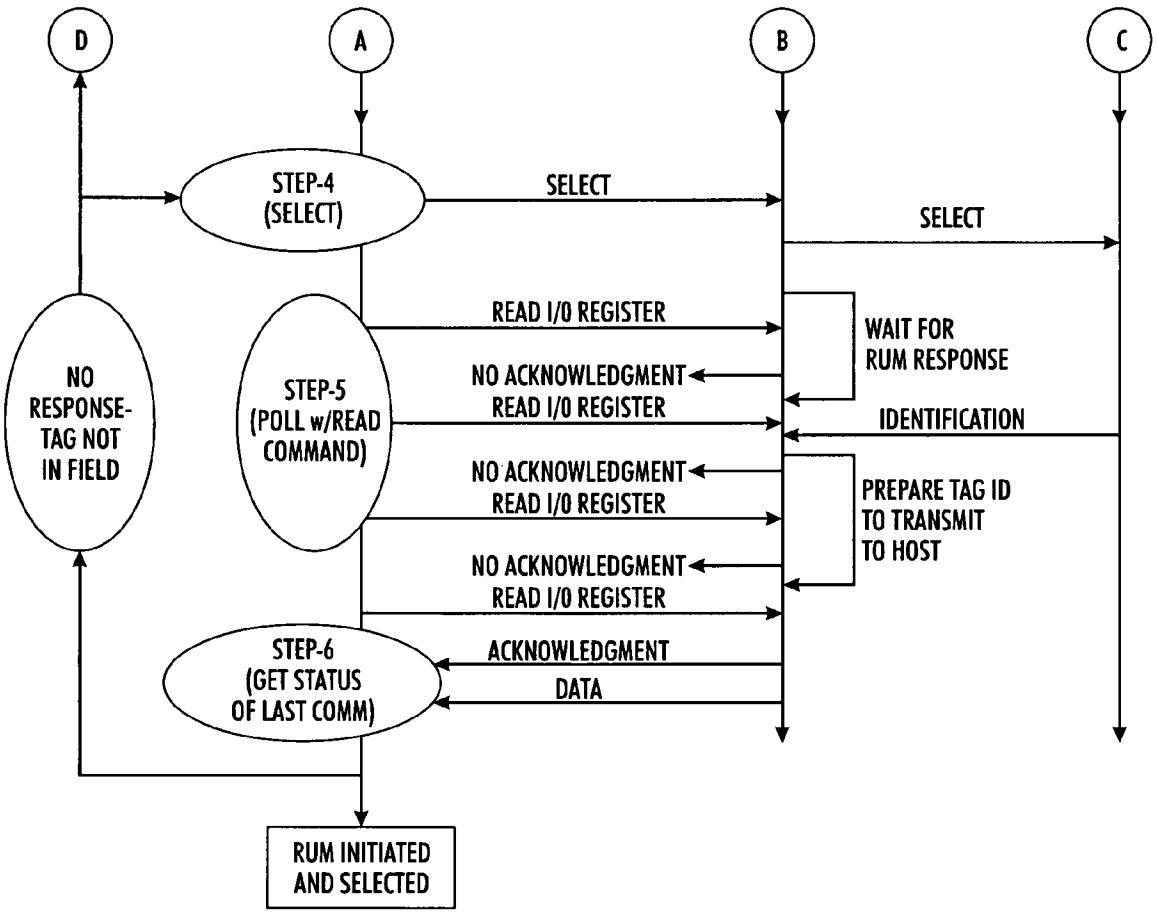
FIG. 3 RELATED ART

FIGS. 2 and 3 illustrate a related-art sequence diagram that outlines the steps to Initiate and Select a tag. As shown in FIGS. 2 and 3, the host processor 110 may be required to be involved in multiple steps of a tag initiation process. In the first step, the host processor 110 sends an "initiate" command to the coupler board 120. Next, during the second step of the initiation process, the host processor 110 performs other tasks or actively polls for an acknowledgement from the coupler board 120 to indicate the completion of the "initiate" task. During this second step, the Coupler board 120 sends the "initiate" command to the CRUM 200. If the CRUM 200 is in the radio frequency field 130, it responds to the "initiate" command from the coupler board 120 by supplying its identification to the Coupler Board. The Coupler board places its identification into the appropriate status register and prepares to transmit it on the I2C bus when the request from the host comes in. This will happen on the next "POLL" by the host.

In the third step of the initiation process, the host processor 110 sends another "POLL" in the form of a "read" command to read the contents of a status register containing information about the last communication attempt. The Coupler would acknowledge this particular POLL, and data would be transferred to the host. The status register would reside at the coupler board and be an integral part of the coupler chip (not shown) 120. The information may indicate the identification of the CRUM 200, a cyclic redundancy check (CRC) error that indicates a failure of the data transmission, or a "no response."

When the information indicates a CRC error or a "no response," the initiation process goes back to step 1, where the host processor 110 again sends an "initiate" command to the coupler board 120. On the other hand, when the information contains an identification of the CRUM, the initiation process proceeds to step 4, in which the host processor 110 sends/writes a "select" command to select the CRUM 200 that is currently in the radio frequency field 130.

Next, in step 5, the host processor 110 actively polls for acknowledgement from the coupler board 120 which indicates the completion of the "SELECT" command. During this waiting time, the coupler board 120 sends the "select" command to the CRUM 200. The CRUM 200 responds to the "select" command from the coupler board 120, if the CRUM 200 is in the radio frequency field 130, by supplying its identification. At this time, the CRUM 200 is Selected, and the Initiation/Selection process is completed. The Coupler board again places the identification into the appropriate status register and prepares to transmit it on the I2C bus when the request from the host comes in. This will happen on the next "POLL" by the host.

As shown in step 6 of FIGS. 2 and 3, after the Coupler acknowledges the host's read request, it transmits the status of the last communication attempt. If there was a no response or a CRC error, the host could start over at step 1. If the communications were successful, the host may perform other communications with the RUM After the completion of the initiation process, the host processor 110 may perform tasks, such as read, write, authenticate, etc., with respect to the CRUM 200.

The multiple-step RUM Selection process, as discussed previously, requires considerable activity from the host processor 110. Regardless of the type of system (polling routine, interrupt-driven, or hybrid), significant amount of real processor time is required from the host processor 110 just to enable interaction with the CRUM 200. Especially, when the CRUM 200 is dynamically moving into and out of the radio frequency field 130 of the coupler board 120, excessive processor activity may be needed to successfully enable interaction with the CRUM 200. The host processor 110 may have to repeatedly move through all the five steps in the Initiation/Selection process, as described above, until a CRUM has moved into the radio frequency field 130 and successfully identified by the coupler board 120. The processing time of the host processor 110 used in the initiation process when there is no CRUM in the radio frequency field 130 is wasted.

Figure 4:
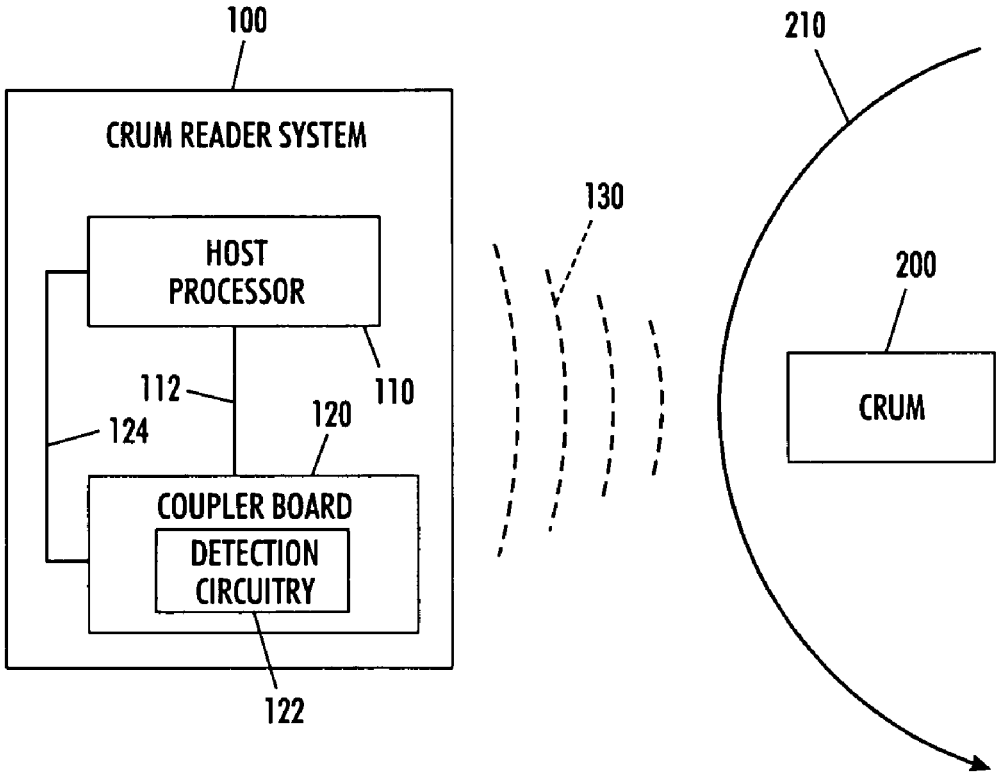
FIG. 4 illustrates an RUM reader system having added electronic circuitry.

FIG. 4 illustrates a CRUM reader system 100 having an added electronic circuitry 122 in the coupler board 120 to perform detection of a CRUM. With this ability, the coupler board 120 automatically detects, initiates and/or selects a RUM upon receiving a command from the host processor 110, without needing the host processor 110 to be involved in the process of detecting or interacting the RUM. The CRUM reader system 100 in FIG. 4 is similar to that shown in FIG. 1. Thus, like elements are labeled with the same numeral references, and are not described again.

The CRUM reader system 100 in FIG. 4 differs from that in FIG. 1, in that detection circuitry 122 is added to the coupler board 120. With the detection circuitry 122 added to the coupler board 120, the host processor 110 is able to delegate the process of Detecting, Initiating and Selecting an RF CRUM to the coupler board 120 by issuing a single "Auto-Detect," "Auto-Initiate" or "Auto-Select" command. The coupler board 120, upon receiving the single command from host processor 110, automatically performs the corresponding process, such as Detection, Initiation and Selection.

Figure 5:
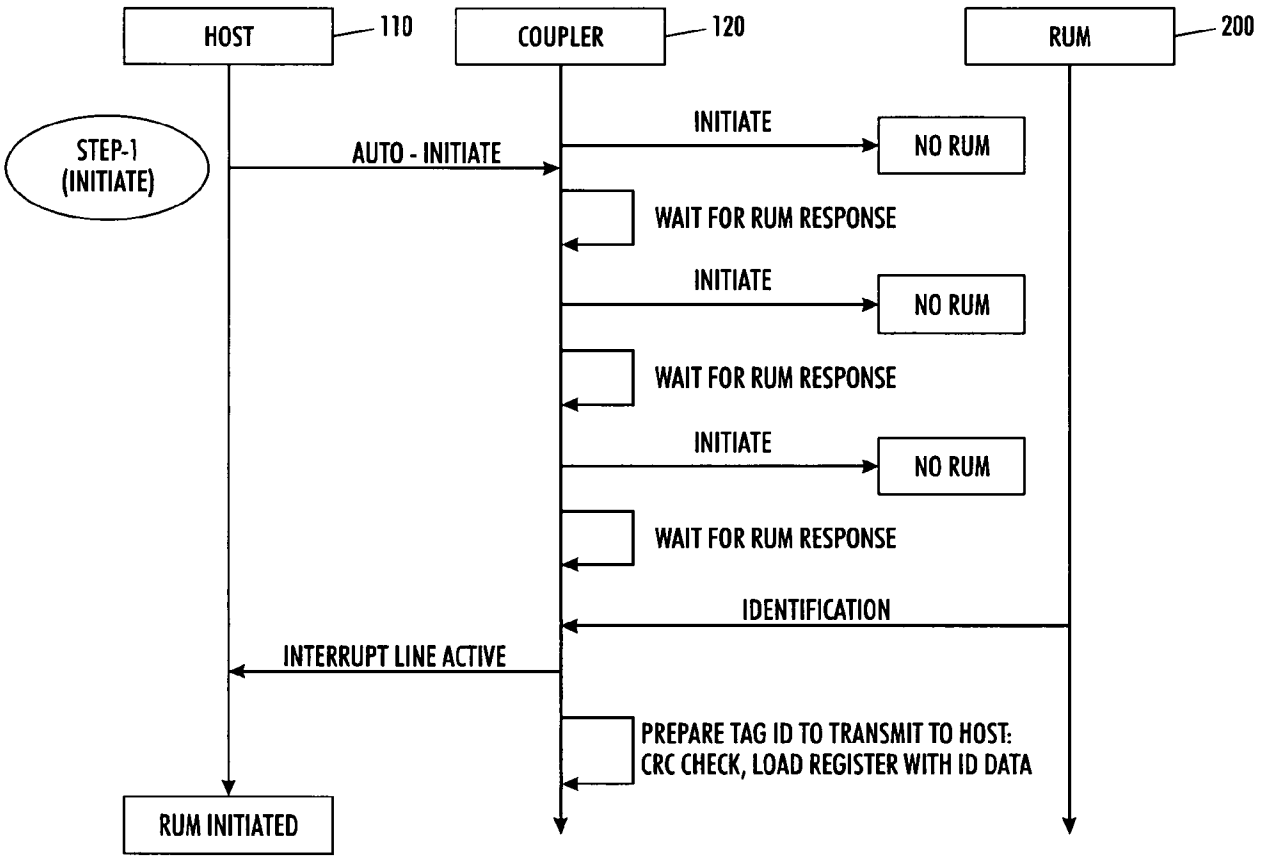
FIG. 5 illustrates a sequence for tag Initiate.

FIG. 5 illustrates a sequence for tag Initiate. As shown in FIG. 5, the coupler board performs "initiate" of a CRUM. The "initiate" step may be repeated, as necessary. Thus, the host only needs to send a single Auto-Initiate command. The coupler board repeatedly attempts to enable communication with the RUM by repeatedly sending an Initiate command. This continues until a CRUM is properly Detected, Initiated or Selected, or until the host processor 110 commands the coupler board 120 to stop the initiation process. These processes would not require any interaction between host processor 110 and the CRUM.

As shown in FIG. 4, the coupler board 120 includes the detection circuitry 122. With the addition of the detection circuitry 122, the coupler board 120 is able to respond to new commands such as the Auto-Detect, Auto-Initiate, and/or Auto-Select commands from the host processor 110 by performing the function that is related to the particular command. These commands, "Auto-Detect", "Auto-Initiate", and "Auto-Select", are new commands added to the previously discussed predetermined command set that the coupler chip may be capable of responding to. Thus, the predetermined command set may include Auto-Detect, Auto-Initiate, Auto-Select, read, write, authenticate, etc. For example, a coupler board may produce, put, or modulate an "Auto-Detect" command onto the RF Carrier. If a tag is in the field such that it receives the command, it immediately responds to the coupler (see FIG. 5). The response would be in the form of an 8 bit random number that represents the tag's or RUM's ID or it could be in a form that represents a communications error. Either way the response would indicate that there is at least one tag in the field. Depending on the result of the RUM's response the coupler may immediately: 1) resend the INITIATE command, 2) send a SELECT command to the tag which creates a "link" between the coupler and that particular tag (some systems might have multiple tags in the RF field at one time), 3) notify the host that there is a tag in the field, 4) notify the host and also perform a SELECT command, or 5) issue the SELECT command and notify the host after a successful tag SELECT.

If there is no tag (RF-RUM) in the field, the Coupler may continuously repeat the command until a tag is Detected, Initiated, or Selected.

Figure 6:
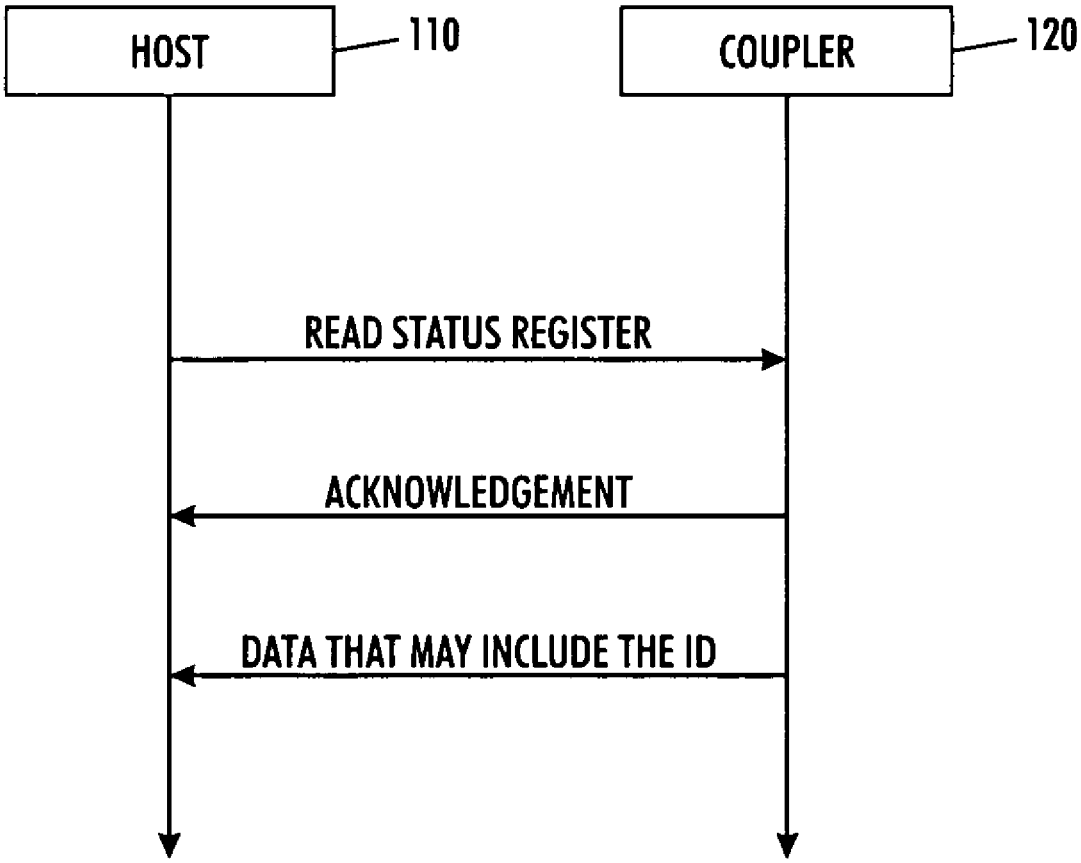
FIG. 6 illustrates a sequence after completion of an Auto-Detect, Auto-Initiate, or Auto-Select sequence.

FIG. 6 illustrates a sequence after completion of an Auto-Detect, Auto-Initiate or Auto-Select sequence. As shown in FIG. 6, after completion of a CRUM initiation, the host may read the coupler's status register to interpret the status of the last communications. The coupler, in response, may send an acknowledgement and/or data that may include the identification of the CRUM.

Figure 7:
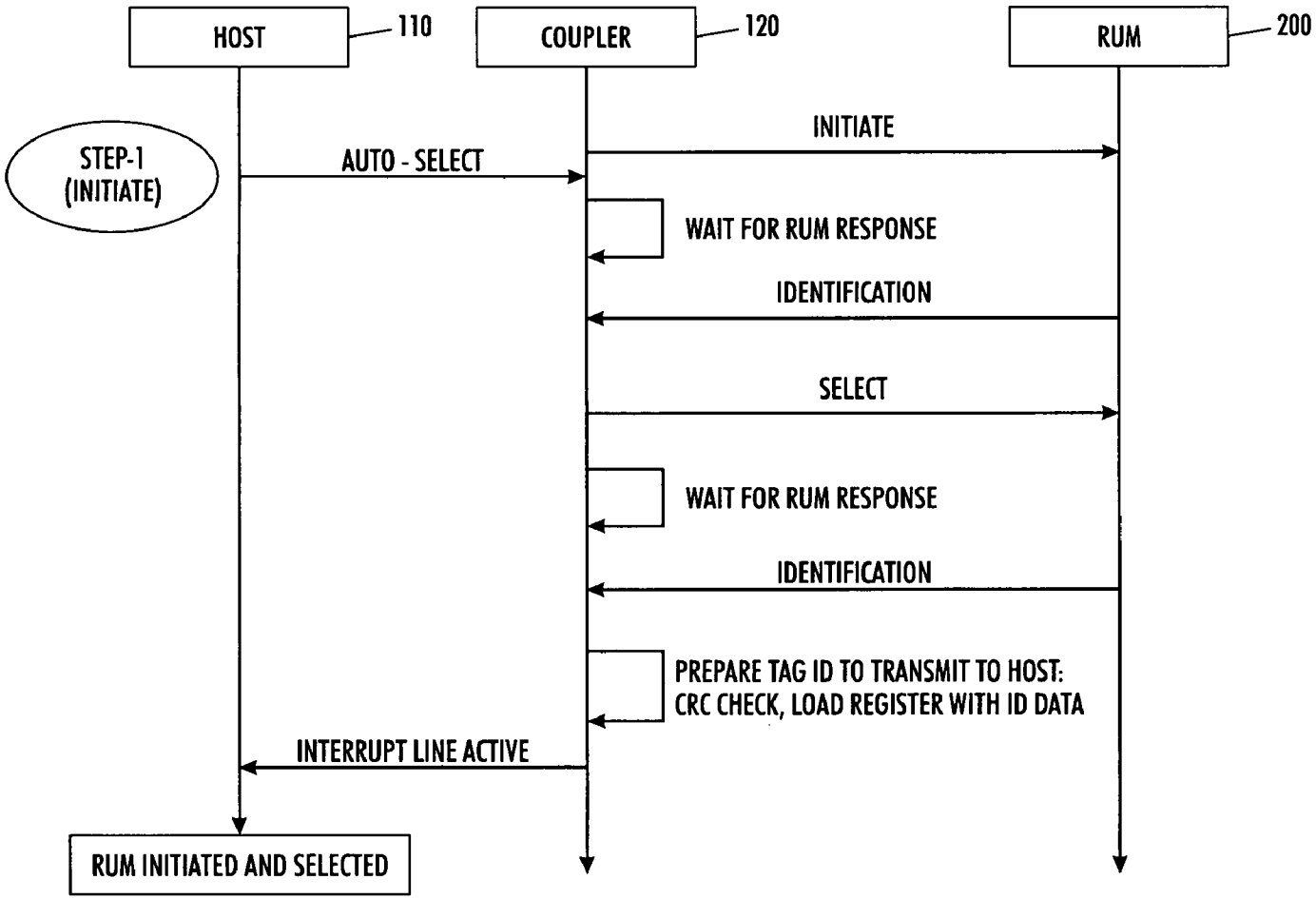
FIG. 7 illustrates a sequence for tag Initiate and Select.

FIG. 7 illustrates an Auto-Select sequence for tag Selection. As shown in FIG. 7, with the added detection circuitry 122, the coupler board 120, upon receiving an Auto-Select command from the host processor 110, is able to perform the repeated Initiation routine, ID collection and Selection routine without interacting with the host processor 110 until an RF-RUM is Selected or until the host processor 110 commands the coupler board 120 to stop the initiation process. For an Auto-Initiate command the coupler will repeatedly attempt to enable communications with the RUM by repeating the Initiate routine. This will continue until an RUM has responded with its identification number or the host tells the Coupler to stop. The host processor 110 may request that the coupler report the results of the initiation process that is automatically performed by the coupler board 120. The polling by the host processor 110 does not require the host processor 110 to participate in the initiation process or to interact with the CRUM. The results may indicate whether a CRUM has been detected, or initiated. For an Auto-Detect command the coupler will repeatedly attempt to enable communications with the RUM by repeating the Initiate routine. In this case if an RUM communication is detected the Coupler will notify the host. Otherwise the Coupler will continue sending the Initiate command until told to stop by the host.

For example, a tag is INITIATED when, after sending the "Initiate" Command, the coupler reads 8 bits of a status register that records the status of the last Coupler to tag communication attempt. This number may indicate that the last communications attempt resulted in a "no RF-RUM response", "correct RF-RUM response" or a data corruption has occurred with the RF-RUM response. Initiation would result due to an Initiate command that has returned a correct RF-RUM response. RF-RUM Detection would result due to an Initiate command that has returned a CRC error. In this case the host would know for sure that there is a tag in the field, but it would not know the ID of the tag. A tag is SELECTED when the same occurs after sending a "Select" Command.

After completion of a CRUM selection, the host may issue read the coupler status register to interpret the status of the last communications, in a sequence similar to that shown in FIG. 6. The coupler, in response, may send an acknowledgement and/or data that may include the identification of the CRUM.

When a tag is moving, the coupler may repeatedly attempt to enable communication with the RUM by repeatedly sending an Initiate command until a tag moves into the field. In particular, as shown in FIG. 5, the coupler would wait for CRUM response after issuing an Initiate command. The coupler would repeat this process until the tag moves into the field and responds to the coupler. The coupler may then activate the interrupt line. The coupler may also prepare the tag ID to transmit to the host, including performing CRC check and loading the coupler status register with the ID data. After completion of a CRUM initiation, the host may issue a read command to the coupler to retrieve the contents of the status register to interpret the status of the last communications, in a sequence similar to that shown in FIG. 6. The coupler, in response, may send an acknowledgement and/or data that may include the identification of the CRUM.

Figure 8:
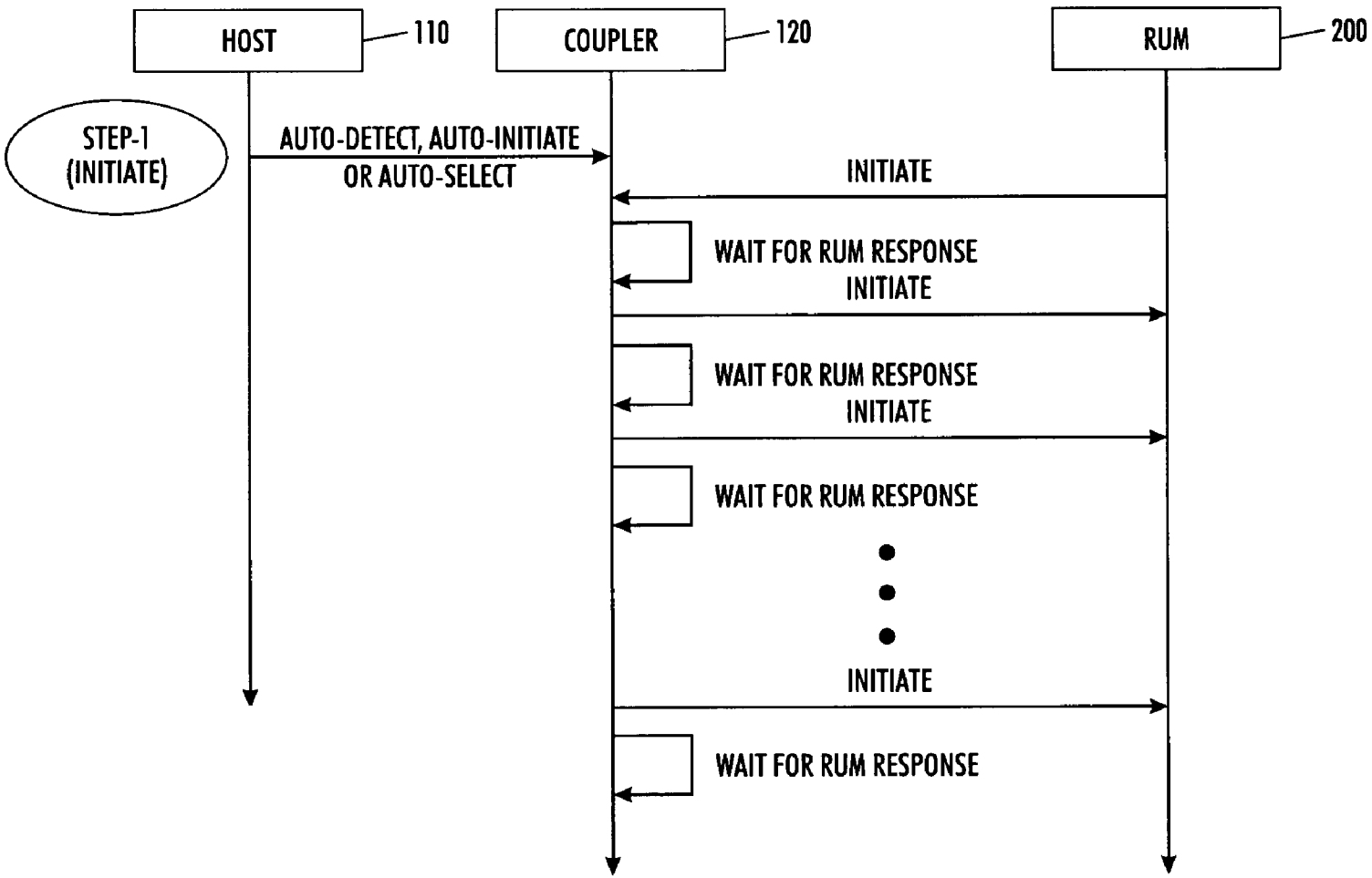
FIG. 8 illustrates another sequence for tag Initiate and Select.

FIG. 8 illustrates what the sequence for any of the new commands would look like when there is no RUM in the Couplers RF field. As shown in the example in FIG. 8, while the coupler continues to repeatedly attempt to enable communications with the RUM, the RUM does not move into the field. Thus, the Initiation cannot be completed. As a result, CRUM Select cannot be performed. The coupler may stop the sequence when the host sends a stop command over the data bus.

More than one CRU may be provided in a marking device, and the coupler board 120 may initiate CRUMs in each of the CRUs. Accordingly, the results polled by the host processor 110 from the coupler board 120 may indicate which and how many CRUMs have been detected, initiated or selected.

Alternatively, the coupler board 120 may report to the host processor 110 when a CRUM is detected, initiated or selected. Such a report may be in the form of a data signal. The data signal may be sent from the coupler board 120 to the host processor 110 via a separate dedicated line 124. The dedicated line 124 may be connected to an interrupt, such as a high level interrupt, which ensures immediate service when flagged. The dedicated line 124 may also indicate to the host processor 110 a "go/no-go" condition to indicate whether it is possible to communicate with a CRUM.

The coupler board 120 may also report to the host processor 110 using the data/control bus 112 with an inter-integrated circuit ($I^2C$ or I2C) interface. For example, after sending the auto-select command to the coupler board 120, the host processor 110 may release the data/control bus 112 to allow the coupler board 120 to take control of it and pull it low/down when a CRUM has been selected/detected. To accomplish this some additional circuitry on the host side to monitor the data line and alert the host when its state has changed.

With the addition of the detection circuitry 122, the coupler board 120 is also able to be pulled out of the "auto select" mode by the host processor 110. For example, the looping process, i.e., the process of repeatedly checking for the presence of a CRUM, may be predicated on a clock, a data line, or a combination of a clock and a data line. When an $I^2C$ bus is used to interface between the host processor 110 and the coupler board 120, the host processor 110 may issue a STOP command, to bring the coupler board out of the looping routine. The I2C STOP command may be a low to high transition on the data line while the clock is high.

Systems, such as the coupler/host system shown FIG. 4, may be included in a marking device, such as a digital photocopier, a xerographic marking device, an ink-jet printer, or the like.

Figure 9:
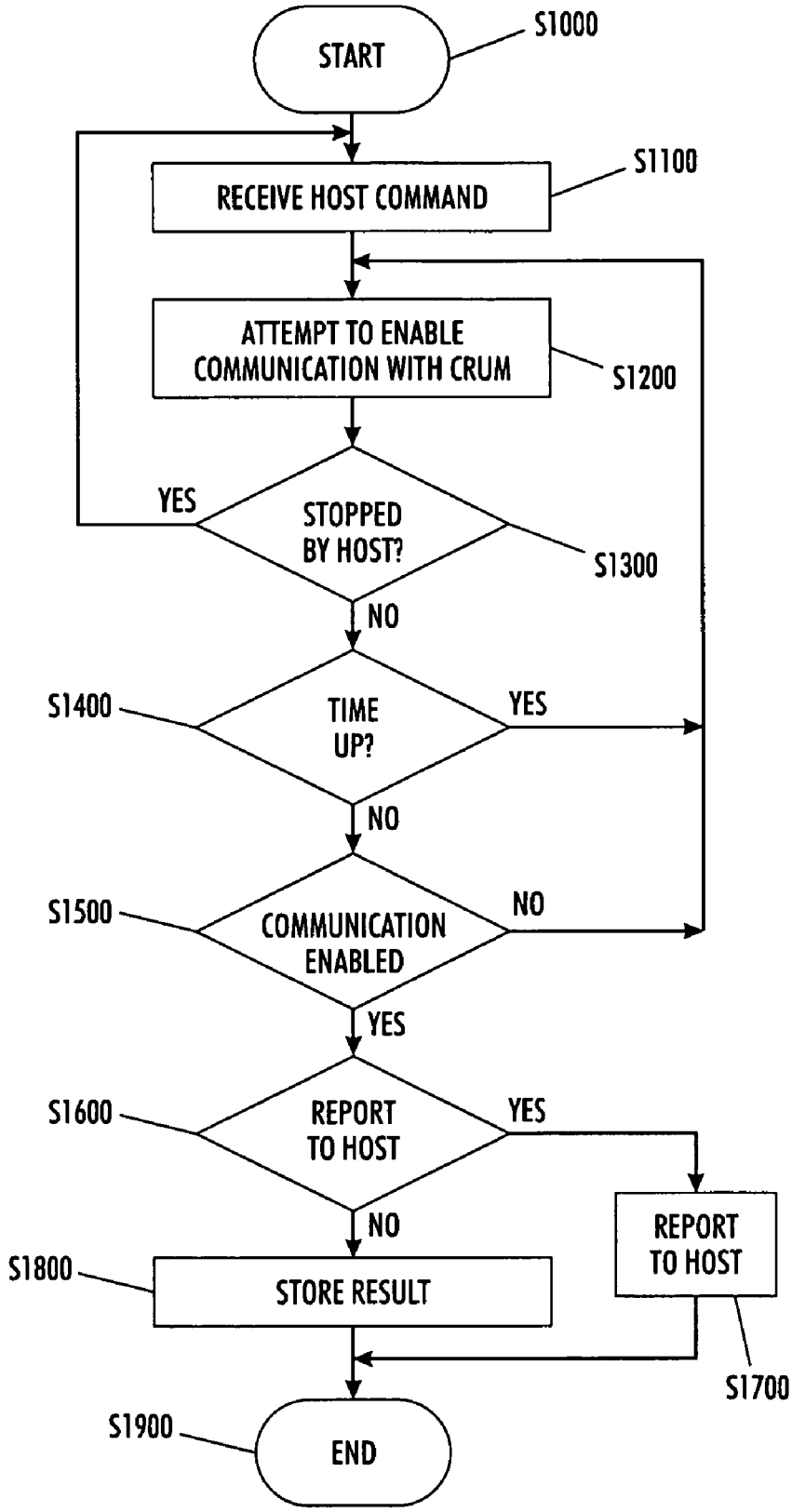
FIG. 9 is a flowchart outlining a method for initiating an RUM.

FIG. 9 illustrates a flowchart outlining an exemplary embodiment of a method for auto-selecting a CRUM. As shown in FIG. 9, beginning in step S1000, operation of the method continues to step S1100, where a coupler board receives a command from a host processor for enabling communication with a CRUM. Next, in step S1200, the coupler board attempts to enable communication with a CRUM.

Then, in step S1300, it is determined whether the host processor has commanded a stop of the process. If it is determined at step S1300 that the host processor has not commanded a stop of the process, operation of the method proceeds to step S1400. On the other hand, if it is determined at step S1300 that the host processor has commanded a stop of the process, operation of the method returns to step S1100 for the next command from the host processor.

Next, in step S1400, a determination is made whether a predetermined time period has expired. If it is determined at step S1400 that the predetermined time period has not expired, operation of the method proceeds to step S1500. On the other hand, if it is determined at step S1400 that the predetermined time period has expired, operation of the method returns to step S1200 for another attempt to enable communication with a CRUM.

Next, in step S1500, it is determined whether communication with a CRUM has been enabled. If it is determined in step S1500 that communication with a CRUM has not been enabled, operation goes back to step S1200 for another attempt to enable communication with a CRUM. On the other hand, if it is determined in step S1300 that communication with a CRUM has been enabled, operation proceeds to step S1600.

In step S1600, it is determined whether the coupler board needs to report to the host processor that communication with a CRUM has been enabled. If it is determined in step S1600 that the coupler board needs to report to the host processor, operation of the method jumps to step S1700, where the coupler board reports to the host processor. Thereafter, operation proceeds to step S1900, where operation of the method ends.

On the other hand, if it is determined in step S1600 that the coupler board does not need to report to the host processor, operation proceeds to step S1800. In step S1800, the result of the process is stored. The result is accessible to and may be polled by the host processor. Thereafter, operation continues to step S1900, where operation of the method ends.

It is noted that, in step S1100, the command for enabling communication with a CRUM may be an "auto-detection," "auto-initiate" or "auto-select" command. After receiving an "auto-detection" command, the coupler board, in step S1200, sends an "initiate" command via the RF carrier and looks for a response from a CRUM. In step S1600, a communication is enabled when the coupler board detects a response from a CRUM, regardless whether the response is a CRC error or a chip-ID.

Alternatively, after receiving an "auto-initiate" command, the coupler board, in step S1200, sends an "initiate" command via the RF carrier and looks for a response from a CRUM. In step S1600, a communication is enabled only when the coupler board detects a chip-ID from a CRUM.

Alternatively, after receiving an "auto-select" command, the coupler board, in step S1200, sends an "initiate" command via the RF carrier and looks for a response from a CRUM. The coupler board repeatedly sends an "initiate" command until a chip-ID is detected. Then, the coupler board sends a select command and wait for a valid select response with matched chip-ID. In step S1600, a communication is enabled only when the coupler board detects a valid select response with matched chip-ID from a CRUM.

The method illustrated in FIG. 9 may be implemented in a computer program product that can be executed on a computer. The computer program product may be a computer-readable recording medium on which a control program is recorded, or it may be a transmittable carrier wave in which the control program is embodied as a data signal.

While various details have been described, these details should be viewed as illustrative, and not limiting. Various modifications, substitutes, improvements or the like may be implemented within the spirit and scope of the foregoing disclosure.

What is claimed is:

1. A replaceable unit monitor (RUM) reader system, comprising:

a host processor that outputs a command; and a coupler board including a detection circuitry that, upon receiving the command from the host processor, repeatedly attempts to enable communication with a replaceable unit monitor (RUM) without requiring a further command from the host processor.

2. The system of claim 1, the command being an auto-detect command, and the coupler board repeatedly sending an initiate command until the coupler board detects a chip identification or a cyclic redundancy check (CRC) error from an RUM, or until the host processor stops the coupler board.

3. The system of claim 1, the command being an auto-initiate command, and the coupler board repeatedly sending an initiate command until the coupler board detects a chip identification from an RUM, or until the host processor stops the coupler board.

4. The system of claim 1, the command being an auto-select command, the coupler board:

repeatedly sending an initiate command until the coupler board detects a chip identification, or until the host processor stops the coupler board, and after detecting a chip identification, repeatedly sending a select command until the coupler board detects a valid select response, or until the host processor stops the coupler board.

5. The system of claim 1, wherein the host processor sends the command to the coupler board via a data/control bus.

6. The system of claim 1, wherein the host processor writes the command to the coupler board via an inter integrated circuit I2C interface.

7. The system of claim 6, wherein:

the host processor releases the inter integrated circuit interface after writing the command; and the coupler board reports a result of attempting to enable communication with an RU (replaceable unit) to the host processor via the inter integrated circuit interface.

8. The system of claim 1, wherein the coupler board reports a result of attempting to enable communication with an RU (replaceable unit) to the host processor via a dedicated line.

9. The system of claim 8, wherein the dedicated line includes a connection to an interrupt for indicating the result of attempting to enable communication with an RUM.

10. The system of claim 1, wherein, after enabling communication with an RUM, the host processor sends a set of predetermined commands to the RUM via the coupler board.

11. The system of claim 10, wherein the RUM is a customer replaceable unit monitor (CRUM).

12. The system of claim 11, wherein the CRUM is a radio frequency identification tag that includes an integrated circuit chip connected to an antenna, the CRUM communicating with the coupler board by varying an impedance of the antenna.

13. A marking device including the system of claim 1.

14. The marking device of claim 13, wherein the marking device is a digital photocopier.

15. The marking device of claim 13, wherein the marking device is a xerographic marking device.

16. A radio frequency identification (RFID) system that incorporates moving tags, comprising the system of claim 1.

17. A method of automatically enabling communication with a replaceable unit monitor (RUM) in a RUM reader system, the RUM reader system comprising a host processor and a coupler board, the coupler board including a detection circuitry, the method comprising:

sending a command from the host processor; and upon receiving the command at the coupler board, the coupler board repeatedly attempting to enable communication with an RUM without requiring a further command from the host processor.

18. The method of claim 17, the command being an auto-detect command, repeatedly attempting to enable communication comprising:

the coupler board repeatedly sending an initiate command until the coupler board detects a chip identification or a cyclic redundancy check (CRC) error from a replaceable unit, or until the host processor stops the coupler board.

19. The method of claim 17, the command being an auto-initiate command, repeatedly attempting to enable communication comprising:

the coupler board repeatedly sending an initiate command until the coupler board detects a chip identification from a replaceable unit, or until the host processor stops the coupler board.

20. The method of claim 17, the command being an auto-select command, repeatedly attempting to enable communication comprising:

the coupler board repeatedly sending an initiate command until the coupler board detects a chip identification, or until the host processor stops the coupler board, and after detecting a chip identification, the coupler board repeatedly sending a select command until the coupler board detects a valid select response, or until the host processor stops the coupler board.

21. The method of claim 17, further comprising:

after enabling communication with an RUM, sending a set of predetermined commands from the host processor to the RUM via the coupler board.

22. The method of claim 21, wherein the RUM is a customer replaceable unit monitor (CRUM).

23. The method of claim 22, wherein the CRUM is a radio frequency identification tag that includes an integrated circuit chip connected to an antenna, the CRUM communicating with the coupler board by varying an impedance of the antenna.

24. A computer-readable medium having computer-executable instructions for performing the method of claim 17.

* * * * *